US011491637B2

(12) United States Patent
Miley et al.

(10) Patent No.: US 11,491,637 B2
(45) Date of Patent: Nov. 8, 2022

(54) ROTATING AND REMOVABLE BIT/DRIVER RAILS

(71) Applicant: APEX BRANDS, INC., Apex, NC (US)

(72) Inventors: Chad Aaron Miley, Camden, OH (US); Eric Jon Van Fossen, Huntersville, NC (US); Brandon Rowlan Stumpf, Parkville, MD (US)

(73) Assignee: APEX BRANDS, INC., Apex, NC (US)

( * ) Notice: Subject to any disclaimer, the term of this patent is extended or adjusted under 35 U.S.C. 154(b) by 0 days.

(21) Appl. No.: 17/297,795

(22) PCT Filed: Nov. 18, 2019

(86) PCT No.: PCT/US2019/061924

§ 371 (c)(1),
(2) Date: May 27, 2021

(87) PCT Pub. No.: WO2020/131269

PCT Pub. Date: Jun. 25, 2020

(65) Prior Publication Data

US 2021/0394354 A1 Dec. 23, 2021

Related U.S. Application Data

(60) Provisional application No. 62/782,416, filed on Dec. 20, 2018.

(51) Int. Cl.
*B25H 3/00* (2006.01)
*B25H 3/02* (2006.01)

(52) U.S. Cl.
CPC ..... *B25H 3/003* (2013.01); *B25H 3/023* (2013.01)

(58) Field of Classification Search
CPC . B25H 3/003; B25H 3/00; B25H 3/02; B25H 3/023; B25H 3/025; B25H 3/021;
(Continued)

(56) References Cited

U.S. PATENT DOCUMENTS 2,341,635 A * 2/1944 Loesch ..... A63F 1/06 294/158
3,804,234 A * 4/1974 Gordon ..... B65D 5/50 229/185.1

(Continued)

OTHER PUBLICATIONS

International Search Report and Written Opinion from related international application PCT/US2019/061924, dated Feb. 7, 2020, all pages cited in its entirety.

*Primary Examiner* — Steven A. Reynolds
*Assistant Examiner* — Prince Pal
(74) *Attorney, Agent, or Firm* — Burr & Forman LLP

(57) ABSTRACT

A rail for holding drivable components within a case may include a body in which a plurality of receptacles configured to receive respective ones of the drivable components are formed, and a retention boss at each opposing end of the body. The retention boss may extend away from an end face of the body. The retention boss further includes an alignment slot formed therein. The rail is removable from or insertable into the case, and is rotatable relative to the case, based on alignment of the alignment slot with retention features formed in the case.

18 Claims, 9 Drawing Sheets

(58) Field of Classification Search
CPC ..... B25H 3/06; B65D 25/107; B65D 45/16; B65D 58/20; B65D 25/10
USPC ..... 206/349, 372, 373, 379.493, 108, 6.1
See application file for complete search history.

(56) References Cited

U.S. PATENT DOCUMENTS 3,878,939 A * 4/1975 Wilcox ..... B25H 3/023 312/200
4,033,455 A * 7/1977 Robison ..... B65D 71/70 206/595
4,424,899 A * 1/1984 Rosenberg ..... A45C 11/00 206/45.23
4,798,292 A * 1/1989 Hauze ..... A61L 2/26 206/439
4,871,354 A * 10/1989 Conn ..... A61J 1/2089 604/416
5,398,810 A * 3/1995 Yao Wang ..... B25H 3/023 206/371
5,464,091 A * 11/1995 Callahan ..... G11B 33/0438
5,823,332 A * 10/1998 Clausen ..... G11B 33/0433 211/41.12
5,826,719 A * 10/1998 Chen ..... B25H 3/028 312/902
5,855,274 A * 1/1999 Piao ..... B25H 3/04 206/478
6,213,296 B1 * 4/2001 Streich ..... B25H 3/003 206/480
6,405,864 B1 * 6/2002 Streich ..... B25H 3/003 206/443
6,755,302 B1 * 6/2004 Streich ..... B25H 3/023 206/379
6,953,114 B2 * 10/2005 Wang ..... B25H 3/003 206/375
6,991,103 B2 * 1/2006 Chen ..... B25H 3/003 206/379
7,322,470 B2 * 1/2008 Brunson ..... B25H 3/021 206/378
7,434,688 B2 * 10/2008 Hu ..... B25H 3/023 206/379
7,900,771 B1 * 3/2011 Meng ..... B25H 3/06 206/759
7,931,143 B1 * 4/2011 Lin ..... B25H 3/021 220/629
8,069,984 B2 * 12/2011 Larson ..... B25H 3/023 206/372
8,235,212 B2 * 8/2012 Heerens ..... G03F 7/707 206/454
8,251,211 B1 * 8/2012 Chen ..... B25H 3/025 220/811
8,336,708 B2 * 12/2012 Potterfield ..... B25H 3/02 206/459.5
8,371,444 B1 * 2/2013 Huang ..... B25H 3/003 206/374
D725,388 S * 3/2015 Cole ..... D3/282
8,992,229 B2 * 3/2015 Spital ..... G09B 1/02 434/259
9,156,156 B2 * 10/2015 Wang ..... B25H 3/021
9,156,157 B2 * 10/2015 Wang ..... B65D 25/107
RE45,787 E * 11/2015 Hurt ..... D3/294
9,254,565 B1 * 2/2016 Wang ..... B25H 3/003
9,375,835 B1 * 6/2016 Lin ..... B25H 3/023
9,421,685 B2 * 8/2016 Meyers ..... B25H 3/006
9,486,912 B1 * 11/2016 Chen ..... B25H 3/02
9,656,384 B1 * 5/2017 Tsai ..... B25H 3/003
9,694,489 B2 * 7/2017 Steele ..... B65D 25/205
9,975,237 B2 * 5/2018 Norris ..... B25H 3/06
10,058,230 B2 * 8/2018 Gobl ..... B65D 19/44
10,286,541 B2 * 5/2019 Huang ..... B65D 21/0219
10,710,235 B1 * 7/2020 Cantlon ..... B25H 3/025
11,268,664 B2 * 3/2022 Pugh, II ..... F21V 21/096
2005/0056559 A1 * 3/2005 Chen ..... B25H 3/003 206/372
2005/0133394 A1 * 6/2005 Liu ..... A45C 11/00 206/349
2005/0211587 A1 * 9/2005 Chen ..... B25H 3/003 206/349
2005/0241974 A1 * 11/2005 Chen ..... B25H 3/003 206/349
2006/0011624 A1 * 1/2006 Shih ..... B25H 3/02 220/4.24
2006/0065557 A1 * 3/2006 Brunson ..... B25H 3/021 206/273
2006/0070900 A1 * 4/2006 Brunson ..... B25H 3/023 206/372
2006/0070902 A1 * 4/2006 Tuan-Mu ..... B25H 3/003 206/378
2008/0060960 A1 * 3/2008 Hu ..... B25H 3/003 206/372
2009/0146032 A1 * 6/2009 Bettenhausen ..... A61B 50/30 248/220.31
2011/0031145 A1 * 2/2011 Larson ..... B25H 3/003 206/372
2011/0111378 A1 * 5/2011 Nguyen ..... G09B 1/02 434/204
2011/0233096 A1 * 9/2011 Michels ..... B65D 25/205 206/459.5
2011/0290697 A1 * 12/2011 Dalhamer ..... A47G 23/06 206/557
2012/0043238 A1 * 2/2012 Christopher ..... B25H 3/003 206/375
2014/0165293 A1 6/2014 Hermansen et al.
2014/0166516 A1 * 6/2014 Martinez ..... A45F 5/021 206/372
2014/0231307 A1 * 8/2014 Wen ..... B25H 3/02 206/736
2015/0258676 A1 * 9/2015 Wang ..... B25H 3/021 206/349
2015/0258677 A1 * 9/2015 Wang ..... B65D 25/107 206/349
2016/0052125 A1 * 2/2016 Steele ..... B65D 25/205 206/349
2016/0053987 A1 * 2/2016 Hsu ..... B25H 3/02 206/372
2016/0107308 A1 * 4/2016 Hsu ..... B25H 3/003 206/349
2016/0290013 A1 * 10/2016 Lin ..... B25H 3/003
2016/0346915 A1 * 12/2016 Lin ..... B25H 3/02
2017/0165829 A1 * 6/2017 Damberg ..... A45C 13/02
2017/0361454 A1 * 12/2017 Hsu ..... B25H 3/003
2019/0168376 A1 * 6/2019 Brocket ..... B25H 3/003
2019/0351540 A1 * 11/2019 Lamb ..... B25H 3/023
2020/0180138 A1 * 6/2020 D'Alessandro ..... B25H 3/00
2020/0200340 A1 * 6/2020 Pugh, II ..... F21V 23/04
2020/0238501 A1 * 7/2020 Baum ..... B25H 3/003
2020/0324399 A1 * 10/2020 Christen ..... B25H 3/003
2021/0078159 A1 * 3/2021 Jiang ..... B65D 21/0213
2021/0197360 A1 * 7/2021 Zhang ..... B25H 3/006
2021/0245358 A1 * 8/2021 Hohl ..... B25H 3/06

* cited by examiner

FIG. 9C.
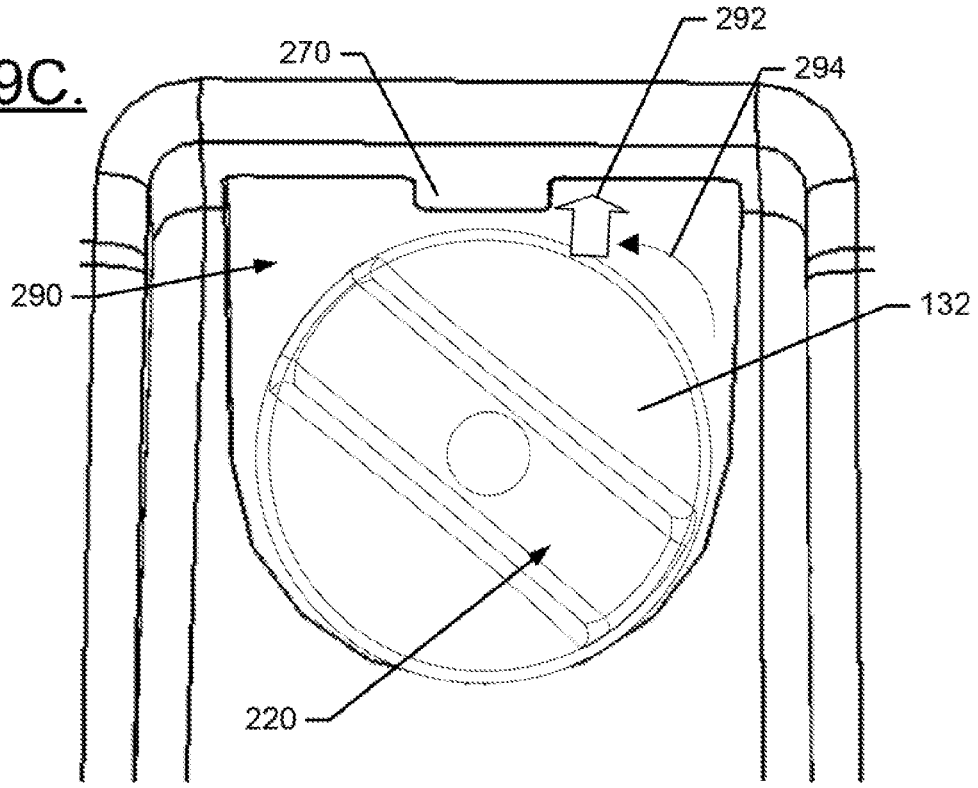
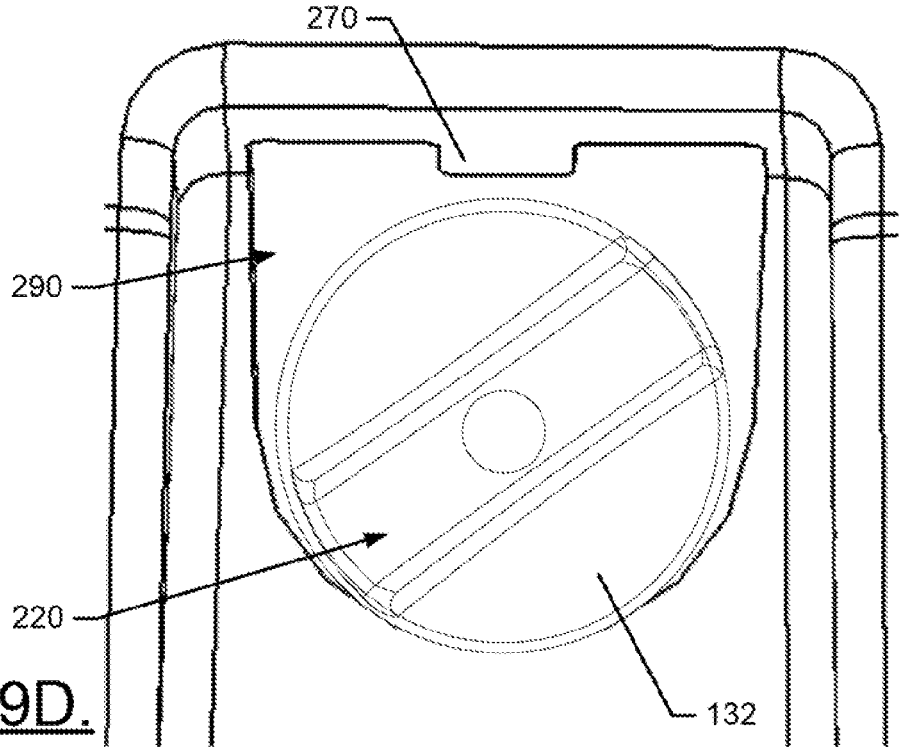
FIG. 9D.

ROTATING AND REMOVABLE BIT/DRIVER RAILS

CROSS REFERENCE TO RELATED APPLICATION

This application claims priority to U.S. application No. 62/782,416 filed Dec. 20, 2018, the entire contents of which are hereby incorporated by reference in its entirety.

TECHNICAL FIELD

Example embodiments generally relate to hand tools and, in particular, relate to a removable and rotatable bit/driver rails for tool cases.

BACKGROUND

Drivable components such as drill bits, drivers and/or the like, have long been sold in sets that include different shapes and sizes. These sets would typically be sold in, or otherwise be capable of storage in cases that were made large enough to handle the entire set. Before the advent of standard-sized hex shanks, the diameter of straight drill bit shanks might vary with the diameter of the bit itself. Thus, the case would have a plurality of slots, each sized to hold a corresponding diameter of drill bit when the bit was secured in its respective slot. Case structures and layouts were therefore strictly dictated by the manufacturer of the cases. Although case structures were defined for numerous combinations and numbers of bits and/or drivers, the structures tended (regardless of how complex) to be relatively inflexible in relation to any ability to rearrange the locations of bits and/or drivers within the case.

However, with hex shanks becoming common, not only can many different sizes (and types) of drill bits all have a common shank size and shape, but many different sizes and types of drivers can also share the common shank size and shape. In particular, a quarter inch hex shank is fairly standard for use with bits and drivers of all types, shapes and sizes. Thus, the same receptacle can be used to hold each and every bit and driver within a case. This may enable the user to mix and match locations of the individual bits and drivers to any desirable set of selected locations within a case that is configured to include a plurality of hex shaped receptacles.

Yet, even with the ability to have any particular drivable component fit into each and every hex-shaped receptacle, the inner structures and arrangements of storage cases have often not been flexible enough to enable users to rearrange storage paradigms. Moreover, users have also not typically been able to shift the storage receptacles to discrete different positions associated with use and storage while also being having full freedom to rearrange storage paradigms.

Thus, it may be desirable to provide a new design for cases and/or the bit/driver receptacles therein.

BRIEF SUMMARY OF SOME EXAMPLES

In an example embodiment, a case for storing drivable components may be provided. The case may include a first half shell and a second half shell operably coupled to each other via a hinge, a frame member included in at least one of the first half shell or the second half shell, and a rail including a plurality of receptacles configured to receive respective ones of the drivable components. The frame member may include rail holding slots disposed in lateral sides of the frame member. The rail may be configured to be removable from the rail holding slots and rotatable in the rail holding slots between selected ones of a plurality of predetermined rail positions.

In another example embodiment, a case for storing drivable components may be provided. The case may include a first half shell and a second half shell operably coupled to each other via a hinge, a frame member included in at least one of the first half shell or the second half shell, and a rail comprising a plurality of receptacles configured to receive respective ones of the drivable components. The frame member may include rail holding slots disposed in lateral sides of the frame member, where each rail holding slot includes an alignment protrusion. The rail may include a body in which each of the receptacles is formed, and a retention boss at each opposing end of the body. The retention boss may extend away from an end face of the body and further include an alignment slot formed therein. The rail may be removable from or insertable into the rail holding slots based on alignment of the alignment slot and the alignment protrusion, and the rail may be rotatable when retained in the rail holding slots.

In another example embodiment, a rail for holding drivable components within a case is provided. The rail may include a body in which a plurality of receptacles configured to receive respective ones of the drivable components are formed, and a retention boss at each opposing end of the body. The retention boss may extend away from an end face of the body. The retention boss further includes an alignment slot formed therein. The rail is removable from or insertable into the case, and is rotatable relative to the case, based on alignment of the alignment slot with retention features formed in the case.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

FIG. 9C is a side view of the boss being retained within the rail holding slot and locked in an in-use position according to an example embodiment; and FIG. 9D is a side view of the boss being retained within the rail holding slot and locked in a storage position according to an example embodiment.

DETAILED DESCRIPTION

Figure 1:
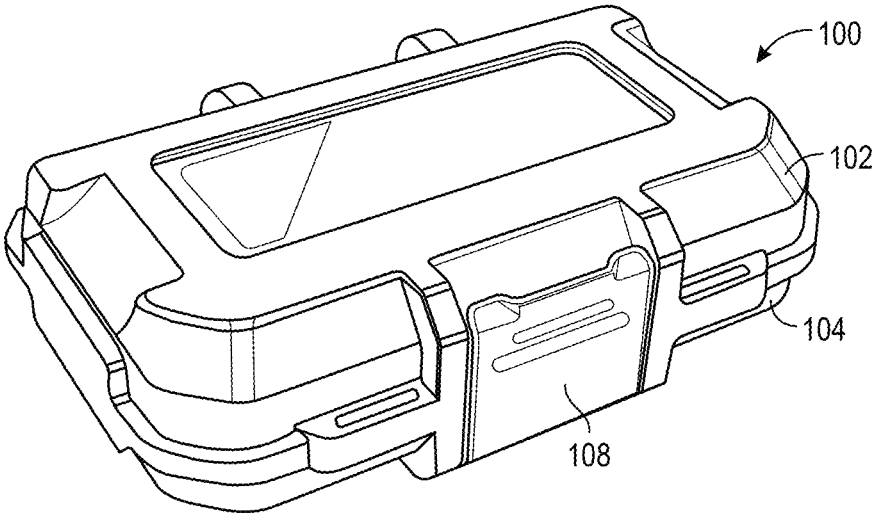
FIG. 1 illustrates a perspective view of a drivable component case according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

As indicated above, some example embodiments may relate to the provision of a fully reconfigurable drivable component case. The frame inside the case may be configured for receiving one or more rails that have a series of drivable component receptacles provided therein. The rails may each be removable from the frame, but also be rotatable to various fixable positions when operably coupled to the frame. The case, the frame and the rails in accordance with an example embodiment will now be described in reference to FIGS. 1-9, which illustrate one physical structure of a working example described above.

Figure 2:
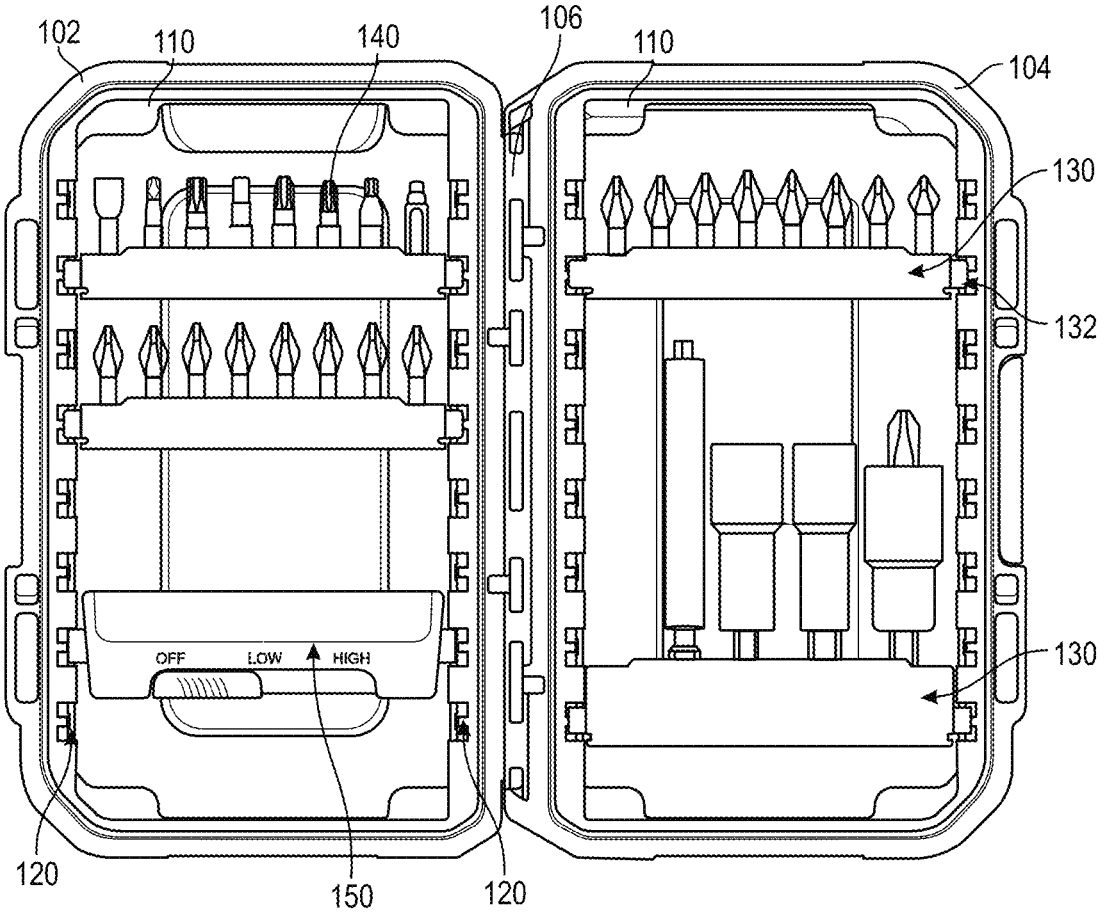
FIG. 2 illustrates top view of the case of FIG. 1 in an opened state according to an example embodiment.

FIG. 1 illustrates a perspective view of a drivable component case 100 according to an example embodiment, and FIG. 2 illustrates the case opened up so that inner portions thereof are visible. As can be appreciated from FIGS. 1 and 2, the case 100 may include a first half shell 102 and a second half shell 104 that may be hingedly attached to each other. The first and second half shells 102 and 104 may each include a base portion (i.e., forming a top wall and a rear wall, respectively) and four sidewalls that each extend perpendicularly away from the base portion (and substantially perpendicular to adjacent ones of the sidewalls) to define a container portion in each respective one of the first and second half shells 102 and 104. When the first and second half shells 102 and 104 rotate about hinge 106 toward each other, respective ones of the sidewalls of the first half shell 102 meet and align with the sidewalls of the second half shell 104 at distal edges thereof. Meanwhile, the base portions of each of the first and second half shells 102 and 104 will lie in parallel planes that are spaced apart from each other by the height of the case 100. A locking mechanism 108 may be provided at sidewalls opposite the hinge 106 to enable the case to be locked in the closed position.

The container portion of each of the first and second half shells 102 and 104 may be configured to include a frame member 110 (or simply "frame"). The frame members 110 of each of the first and second half shells 102 and 104 may be configured to snap fit or otherwise be affixed inside the container portion of their respective one of the first and second half shells 102 and 104. However, in some cases, the frame member 110 of each of the first and second half shells 102 and 104 may be an integral portion of the first and second half shells 102 and 104, respectively. In an example embodiment, the frame members 110 may be configured to engage or otherwise be a portion of the sidewalls of the first and second half shells 102 and 104, and may extend from the base portion along the sidewalls to be flush with distal ends of the sidewalls. When formed separately (i.e., not integrally formed), an outer periphery of the frame members 110 may lie adjacent to an inner periphery defined by the sidewalls of the first and second half shells 102 and 104. Meanwhile, an inner periphery of each of the frame members 110 may be formed to include a plurality of rail holding slots 120. In this regard, an equal number of rail holding slots 120 may be positioned on each opposing lateral side of the frame members 110 to correspond to each other. In other words, the rail holding slots 120 may be disposed in pairs on opposing lateral sides of each of the frame members 110. In the example of FIG. 2, the pairs of rail holding slots 120 may each be equidistant from each adjacent pair of rail holding slots 120. However, it should be appreciated that spacing between adjacent pairs of rail holding slots 120 need not be spaced equidistantly, and instead, any desired spacing therebetween could be employed. Moreover, although the pairs of rail holding slots 120 mirror each other in each of the instances of the frame members 110, such mirroring also does not necessarily need to be employed in alternative embodiments. When formed integrally in the sidewalls, the rail holding slots 120 may effectively be formed in the same manner described above except that due to the integral formation of the frame members 110 in the sidewalls of the first and second half shells 102 and 104, the rail holding slots 120 may be equally considered to be formed in the sidewalls as in the first and second half shells 102 and 104 as in the frame members 110.

As shown in FIG. 2, a plurality of rails 130 may be stored within the case 100. More particularly, one instance of the rails 130 may be inserted into a corresponding pair of rail holding slots 120. The rails 130 may include retention bosses 132 at opposing longitudinal ends of the rails 130. The retention bosses 132 may be configured to interface with the rail holding slots 120 to allow each of the rails 130 to be both removable and rotatable relative to the rail holding slots 120. As will be discussed below, the rails 130 may be rotated to multiple different positions (e.g., one position during insertion and two positions after insertion) in which the rails 130 may be fixed relative to their respective frame member 110. However, at least one of the multiple different positions may be a storage position, which is shown in FIG. 2. In the storage position, bits or drivers (e.g., drivable components 140) that are inserted into the rails 130 and retained therein may lie such that a longitudinal centerline or axis thereof is substantially parallel to the plane of the base portion of the case 100.

In an example embodiment, the drivable components 140 may include bits, sockets, drive heads, etc., of various shapes, sizes and/or types. In this example, each of the drivable components 140 may include a hex shaft (e.g., a quarter-inch hex shaft). Thus, spacing between the rails 130 may be selected such that when the rails 130 are retained in the storage position, a distance between adjacent rails 130 is at least longer than a length of any one of the drivable components 140 retained in one of the adjacent rails 130. However, it should be appreciated that, in some example embodiments, other accessories (e.g., light bar 150) may also be retained by the frame members 110. In this regard, for example, such accessories may also include instances of the retention bosses 132 to interface with a selected pair of the rail holding slots 120 to allow retention, removal and rotation of the accessories in similar fashion to the performance of the same functions relative to the rails 130.

Figure 3A:
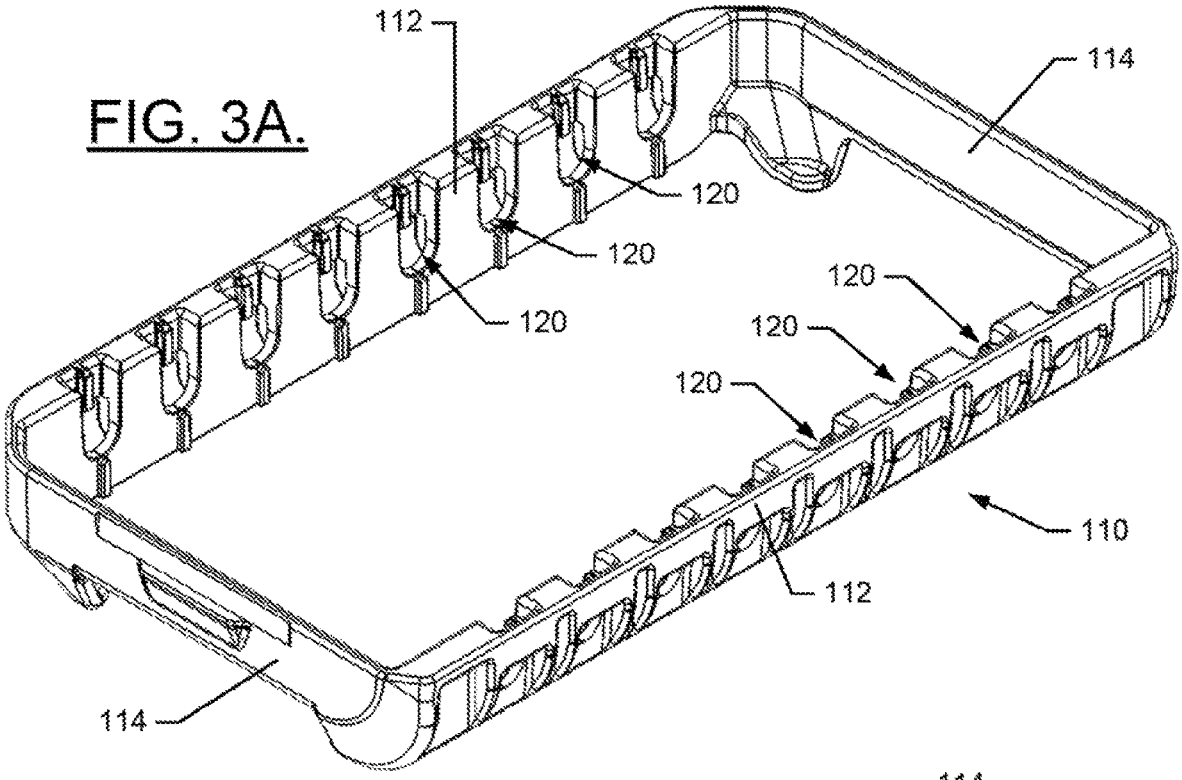
FIG. 3A illustrates a top perspective view of a frame of the case according to an example embodiment.
Figure 3B:
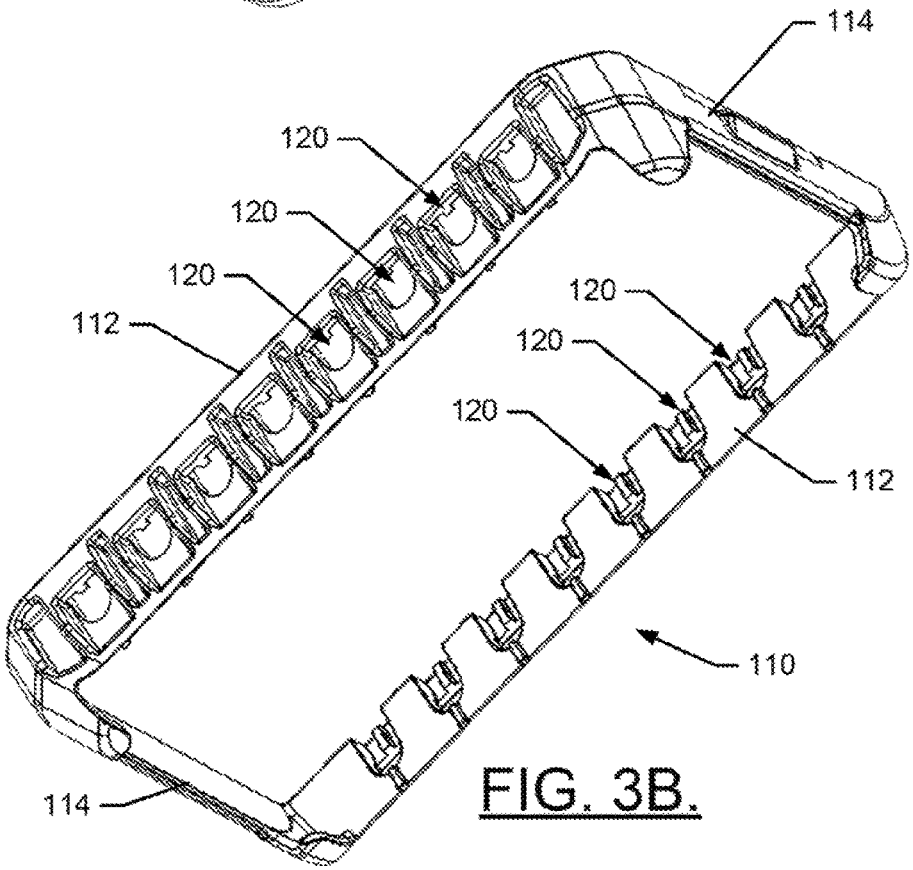
FIG. 3B illustrates a bottom perspective view of the frame of the case according to an example embodiment.
Figure 4A:
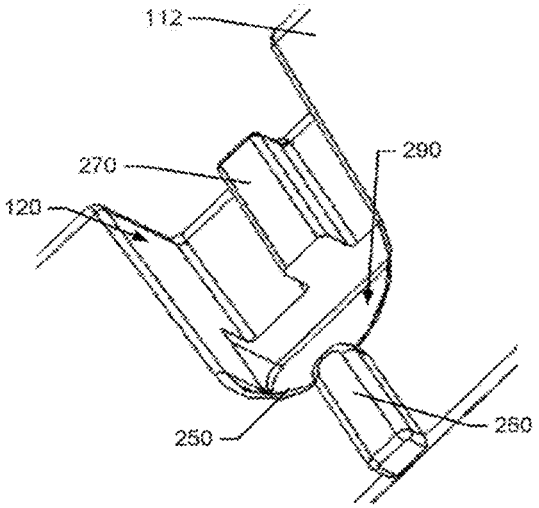
FIG. 4A illustrates a perspective view of a rail holding slot from inside the frame (looking out) according to an example embodiment.
Figure 4B:
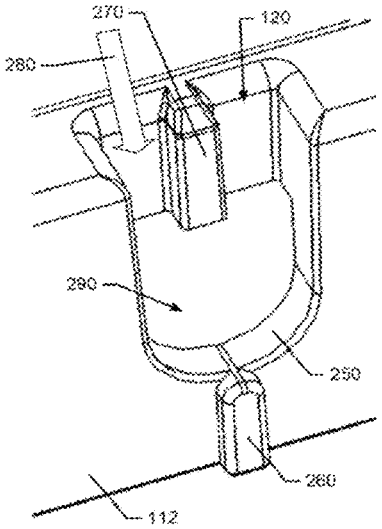
FIG. 4B illustrates an alternative perspective view of the rail holding slot from inside the frame according to an example embodiment.
Figure 4C:
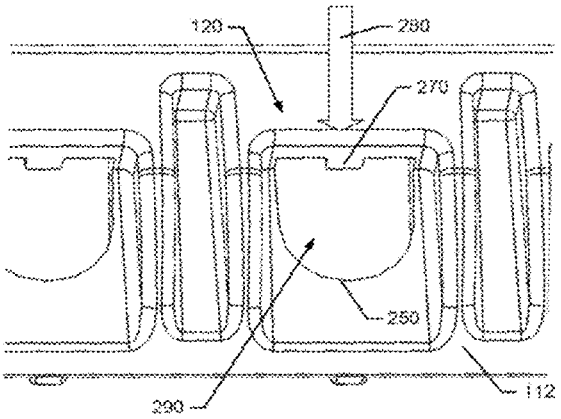
FIG. 4C illustrates a perspective view of a rail holding slot from outside of the frame (looking in) according to an example embodiment.
Figure 5A:
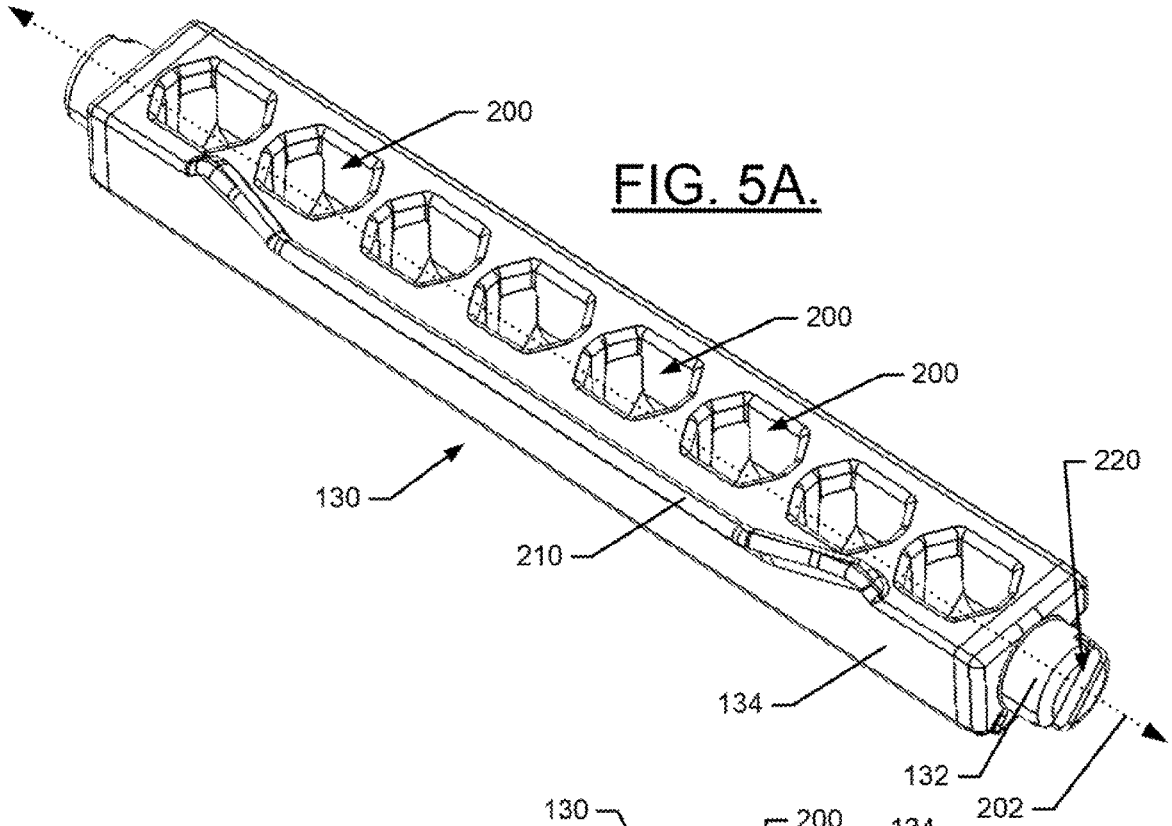
FIG. 5A is a top perspective view of a rotatable and removable rail that interfaces with the rail holding slot of the frame according to an example embodiment.
Figure 5B:
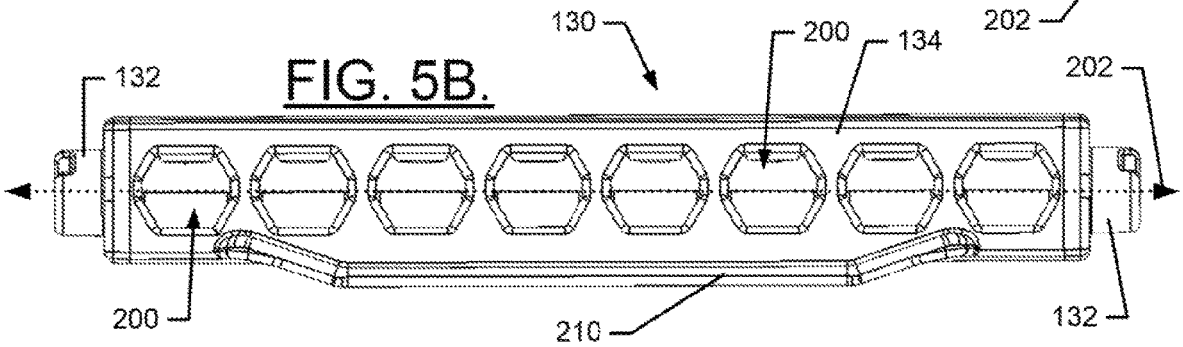
FIG. 5B illustrates a top view of the rotatable and removable rail of FIG. 5A according to an example embodiment.
Figure 5C:
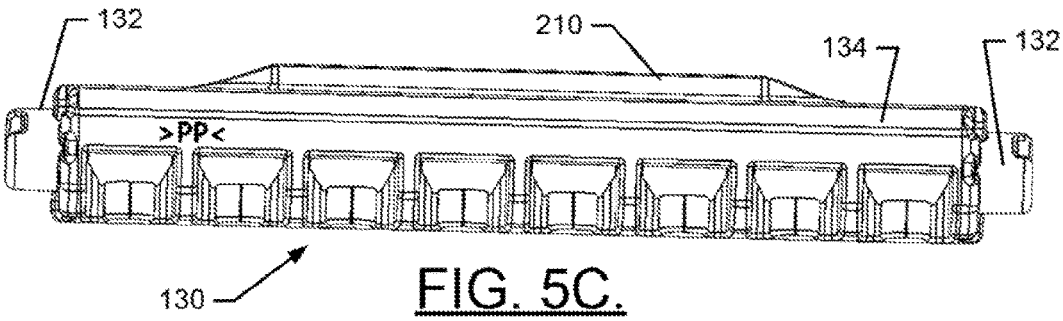
FIG. 5C illustrates a bottom view of the rotatable and removable rail of FIG. 5A according to an example embodiment.
Figure 5D:
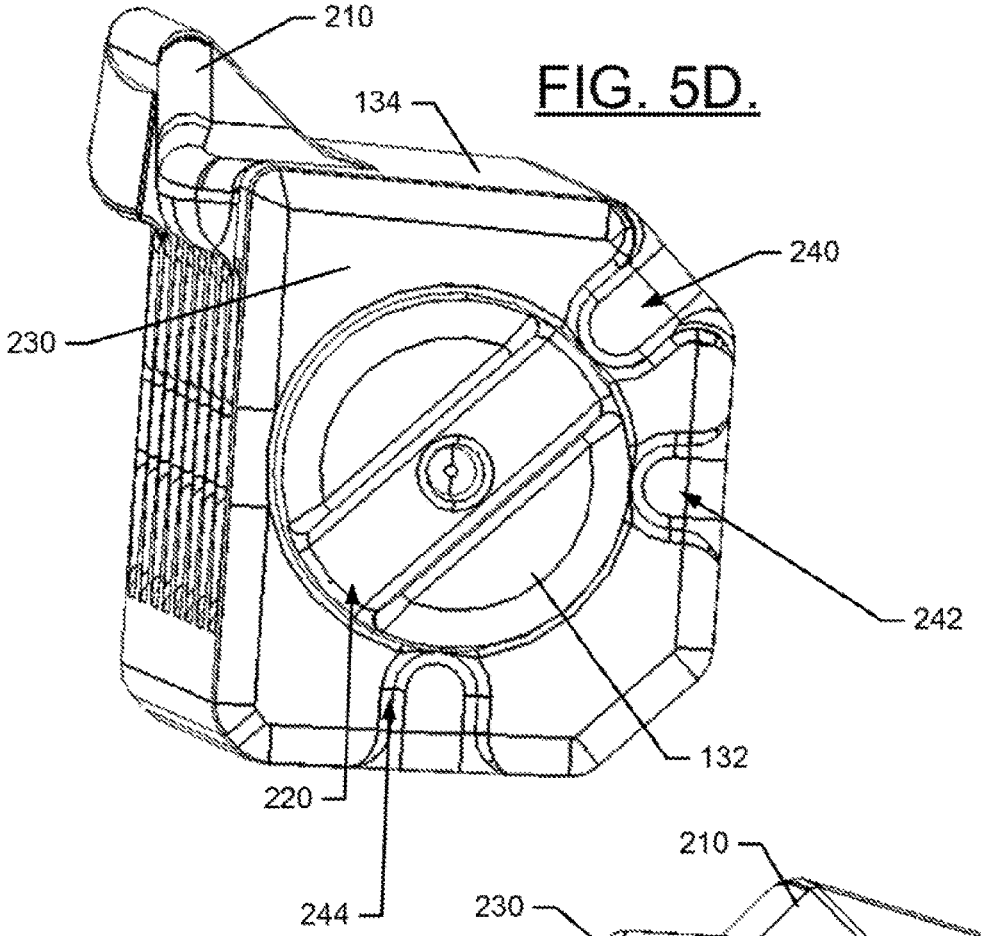
FIG. 5D illustrates a side perspective view of the rotatable and removable rail of FIG. 5A according to an example embodiment.
Figure 5E:
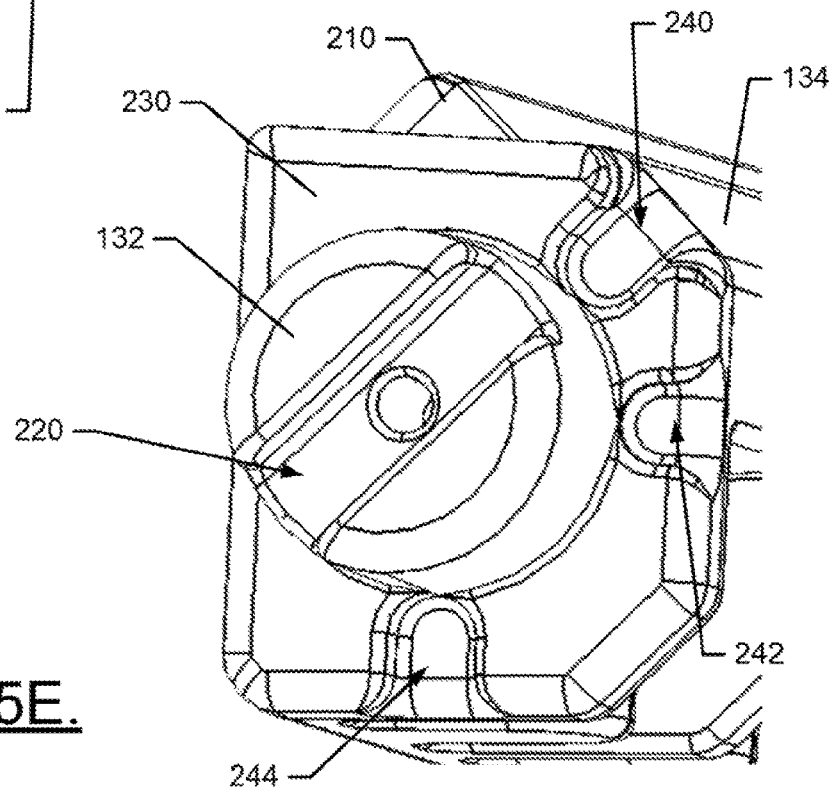
FIG. 5E illustrates another side perspective view of the rotatable and removable rail of FIG. 5A according to an example embodiment.
Figure 6:
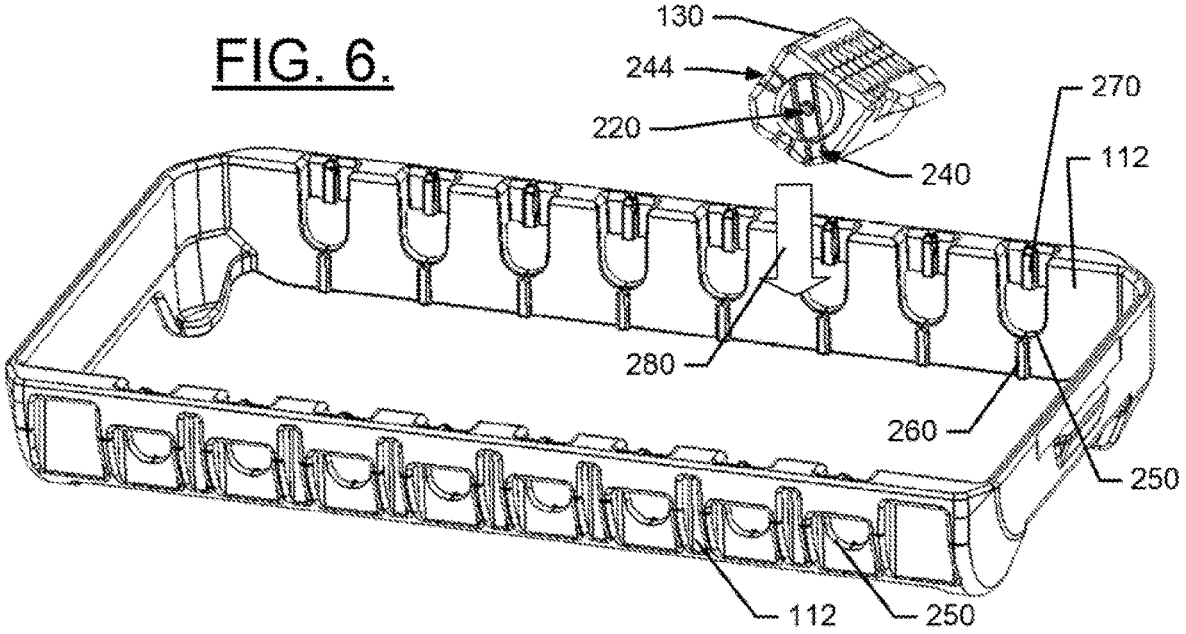
FIG. 6 is a perspective view of one instance of the rotatable and removable rail being aligned for installation into the frame according to an example embodiment.
Figure 7:
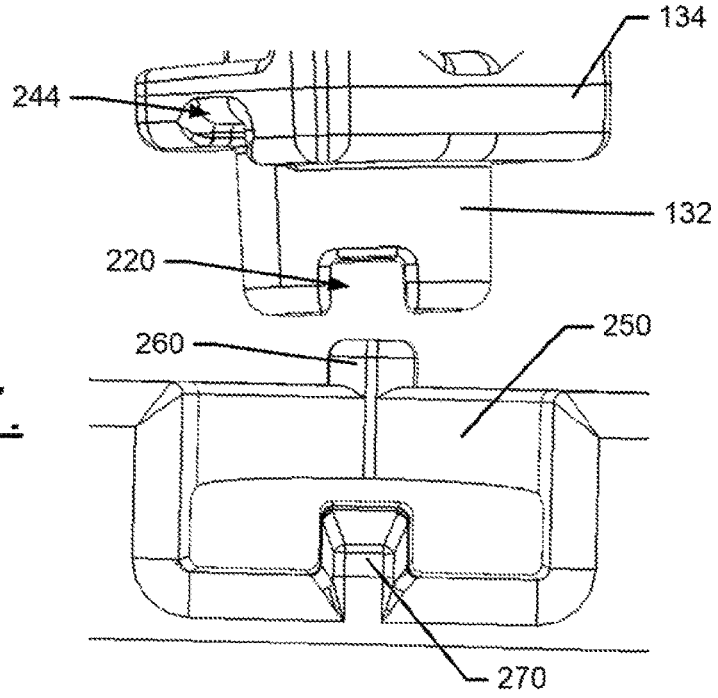
FIG. 7 illustrates a top view of a slot in a boss of the rotatable and removable rail being aligned with an alignment protrusion of the rail holding slot according to an example embodiment.
Figure 8:
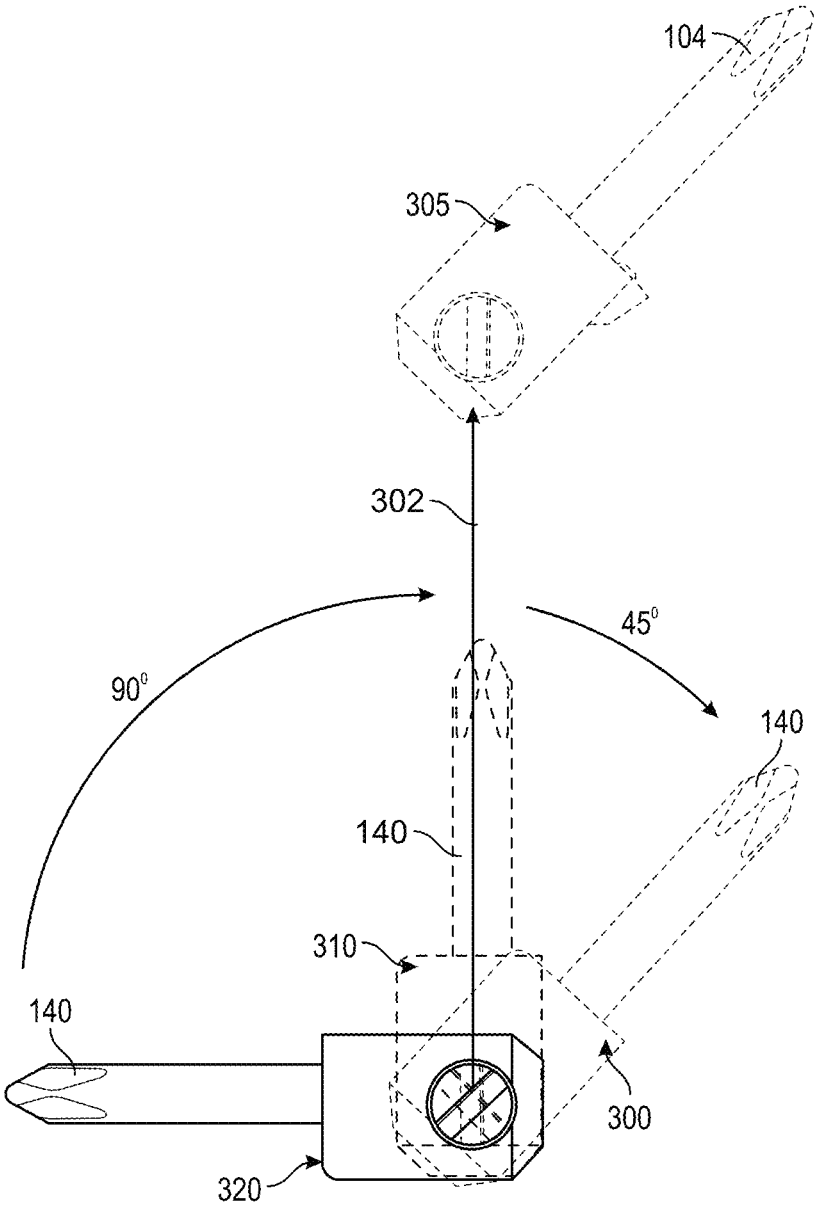
FIG. 8 is a side view showing three installed positions of the rotatable and removable rail according to an example embodiment.

FIGS. 3A and 3B illustrate top and bottom perspective views of one instance of the frame member 110 of the case 100 of FIGS. 1 and 2. FIGS. 4A, 4B and 4C illustrate various views of one instance of the rail holding slot 120 to facilitate a discussion of the same. FIGS. 5A, 5B, 5C, 5D and 5E illustrate various views of one instance of the rail 130 described above in reference to FIGS. 1 and 2. FIGS. 6 and 7 show the rail 130 being aligned for installation into the frame member 110 according to an example embodiment. FIG. 8 shows three fixable positions for the rail 130 based on alignment (or non-alignment) of the retention bosses 132 with alignment features of the rail holding slots 120. FIG. 9 may then be used to describe these alignment or non-alignment conditions in greater detail.

Referring primarily to FIG. 3, which is defined by FIGS. 3A and 3B, the frame member 110 may include lateral sides 112 and transverse sides 114 that are arranged to form a substantially rectangular shape. In this regard, the transverse sides 114 extend parallel to each other between respective ends of the lateral sides 112. The rail holding slots 120 are formed in the lateral sides 114 in pairs that mirror each other in position and structure. In particular, the rail holding slots 120 are formed at least in part by an absence (or removal) of material from the lateral sides 112 to form structures that interface with the rails 130 (and particularly with the retention bosses 132) to enable the rails 130 to be removable from and rotatable within the rail holding slots 120 as described in greater detail below.

As shown best in FIG. 5, which is defined by FIGS. 5A-5E, each instance of the rail 130 may include a plurality of receptacles 200 formed in a body 134 of the rail 130. The receptacles 200 may be substantially hex shaped, and may be configured to retain a quarter-inch hex shaft responsive to insertion of the quarter-inch hex shaft therein. The receptacles 200 may be disposed in a sequential array that is substantially in alignment with a longitudinal centerline or axis 202 of the rail 130 at a top portion of the rail 130. Although eight receptacles 200 are shown in this example, any suitable number may be included in various example embodiments based on the size of the case 100. Each of the receptacles 200 may extend substantially perpendicular to the axis 202 of the rail 130 so that, for example, an axis of each respective one of the driving components 140 that is inserted into the receptacles 200 is perpendicular to the axis 202 of the rail 130 as well. A lip portion 210 may be defined at a top portion of the rail 130 to enable an operator to grasp the lip portion 210 with a finger and rotate the rail 130. The rail 130 may rotate about the axis 202 when inserted into the rail holding slots 120 and not subjected to a force sufficient to cause it to rotate. As mentioned above, the retention bosses 132 may be disposed at opposing longitudinal ends of the rail 130. The axis 202 of the rail 130 may be aligned with an axis of the retention bosses 132.

Each of the retention bosses 132 may include an alignment slot 220 that extends through and forms a groove in a distal end of the retention boss 132. In this regard, the alignment slot 220 may extend substantially perpendicular to the axis 202. As best seen in FIGS. 5D and 5E, the retention boss 132 of each longitudinal end of the rail 130 may extend outwardly away from an end face 230 of the rail 130. The end face 230 may lie in a plane that is substantially perpendicular to the axis 202. The alignment slot 220 may therefore extend in a direction that is parallel to the plane of the end face 230. However, the alignment slot 220 may be spaced apart from the end face 230 due to the extension of the retention boss 132 away from the body 134 of the rail 130.

In an example embodiment, a plurality of locking slots may be formed in the end face 230. Each of the locking slots may have a predetermined orientation relative to the alignment slot 220 and each other. In this regard, a first locking slot 240 may extend radially inwardly from a peripheral edge of the end face 230 toward the axis 202. The first locking slot 240 may be substantially aligned with the alignment slot 220. A second locking slot 242 may be offset from the first locking slot 240 by about 45 degrees. The second locking slot 242 may therefore be substantially aligned with an axis of the driving components 140 when inserted into the receptacles 200 (and therefore the direction of insertion of driving components 140 into the receptacles 200). Thus, as can be appreciated from the description above, the alignment slot 220 may extend across the distal end of the retention boss 132 in a direction that is offset from the direction of insertion of driving components 140 into the receptacles 200 by about 45 degrees. The second locking slot 242 may also extend radially inwardly from a peripheral edge of the end face 230 toward the axis 202.

Meanwhile, a third locking slot 244 may be disposed in the end face 230 to extend radially inwardly from a peripheral edge of the end face 230 toward the axis 202. The second locking slot 242 may be offset from the first locking slot 240 by about 135 degrees and offset from the second locking slot 242 by about 90 degrees. The third locking slot 244 may therefore be substantially perpendicular to the axis of the driving components 140 when inserted into the receptacles 200 (and therefore the direction of insertion of driving components 140 into the receptacles 200).

Each opposing end face 230 may include a corresponding set of the first, second, and third locking slots 240, 242 and 244 that mirror each other. Similarly, each opposing end of the rail 130 may include a retention boss 132 having its own respective instance of the alignment slot 220 formed therein. The retention bosses 132 and alignment slots 220 formed therein may also mirror each other.

Referring primarily to FIG. 4, which is defined by FIGS. 4A-4C, the structural features of the rail holding slots 120 will be described in greater detail. In this regard, the frame member 110 may have a width that is about equal to the length of the rails 130. The rail holding slots 120 may be formed in the lateral sides 112 of the frame member 110 to allow the rail 130 (particularly the retention bosses 132 thereof) to be inserted therein such that a portion of the rail holding slot 120 is closer to the same portion of its respective pair rail holding slot 120 in the frame 110 than the length of the rail 130, while another portion of the rail holding slot 120 is farther from the same portion of its respective pair rail holding slot 120 on the other side of the frame 110 so that the retention bosses 132 fit therebetween. In particular, the rail holding slot 120 may include a collar portion 250 that is spaced apart from the collar portion 250 of the opposing rail holding slot 120 on the other side of the frame member 110 by a distance slightly larger than a length of the body 134 of the rail 130. The collar portion 250 may have a depth that is about equal to a length of the rails 130 from end to end of the retention bosses 132 so that all or nearly all of the retention boss 132 on each opposing end of the rail 130 may rest on the collar portion 250 of its corresponding lateral side 112 when the rail 130 is inserted into the rail holding slots 120. The collar portion 250 may form an arcuate shape having a radius slightly larger than a radius of the retention boss 132. Thus, the retention boss 132 may be supportable on the collar portion 250, but may also be rotatable relative to the collar portion 250 when sufficient force is applied to the retention boss 132 to move it out of a particular position.

Locking of the retention boss 132 may be accomplished using a locking protrusion 260 disposed adjacent to the collar portion 250. In this regard, the locking protrusion 260 may protrude toward a center of the frame member 110 from an inner portion of the lateral side 112 next to each respective collar portion 250. A longitudinal length of the locking protrusion 260 may extend substantially perpendicular to a direction of longitudinal extension of the lateral side 112, and may terminate at or proximate to an apex of the collar portion 250. The locking protrusion 260 may have a width and depth that is substantially similar to a width and depth of the first, second and third locking slots 240, 242 and 244. As will be described in greater detail below, the lock protrusion 260 may be aligned with and inserted into a respective one of the first, second and third locking slots 240, 242 and 244 in order to lock the rail 130 at a particular orientation within the case 100.

Each instance of the rail holding slot 120 may also include an alignment protrusion 270 that extends in a direction parallel to the direction of extension of the locking protrusion 260. The alignment protrusion 270 may have a width and depth (and perhaps also length) that is substantially similar to a width and depth (and length) of the alignment slot 220. The length of the rails 130 from end to end of the retention bosses 132 may be such that the rail 130 cannot be inserted into the rail holding slot 120 unless the alignment protrusion 270 is aligned with the alignment slot 220. However, when the alignments slots 220 on each of the retention bosses 132 are aligned with each other, the rail 130 may be slid downward (in the direction of arrow 280) until the retention bosses 132 clear the bottom of the alignment protrusion 270 entirely and the retention bosses 132 are disposed in a receiving orifice 290 formed between the collar portion 250 and the alignment protrusion 270. The receiving orifice 290 may be larger than a diameter of the retention boss 132 to allow the retention boss 132 to be rotatable therein, whether or not the locking protrusion 260 is engaged with one of the first, second and third locking slots 240, 242 and 244.

Accordingly, as shown in FIGS. 6 and 7, the rail 130 may be positioned above the frame member 110 so that the alignment slot 220 is substantially aligned with the alignment protrusion 270 for each rail holding slot 120 of a given pair. Simultaneously, the rail 130 may be lowered in the direction of arrow 280 so that the alignment protrusion 270 of each of the rail holding slots 120 passes through the alignment slot 220 of each respective retention boss 132. When the alignment protrusion 270 is no longer in contact with the alignment slot 220 and the retention bosses 132 are each located in the receiving orifice 290, the rail 130 can be rotated about the axis 202 within the receiving orifices 290 on respective ends of the rail 130. One of the first, second and third locking slots 240, 242 and 244 may then be aligned with and inserted into the locking protrusion 260 to prevent further rotation of the rail 130 and lock the rail 130 in place. In particular, the first locking slot 240 may be aligned already with the locking protrusion 260 when the alignment protrusion 270 and alignment slot 220 are already aligned. However, once the retention bosses 132 are located in the receiving orifices 290, the retention bosses 132 can be rotated to align and lock in either of the other two lockable positions. Of note, when referring to the locking of the retention bosses 132, it should be appreciated that the term locking could be synonymous with retention (i.e., still being capable of movement with sufficient force) in some cases. Thus, the retention bosses 132 may be considered locked when they will not move unless a rotational force sufficient to overcome the friction or holding forces of the structures retaining the retention bosses 132 are overcome.

Figure 9A:
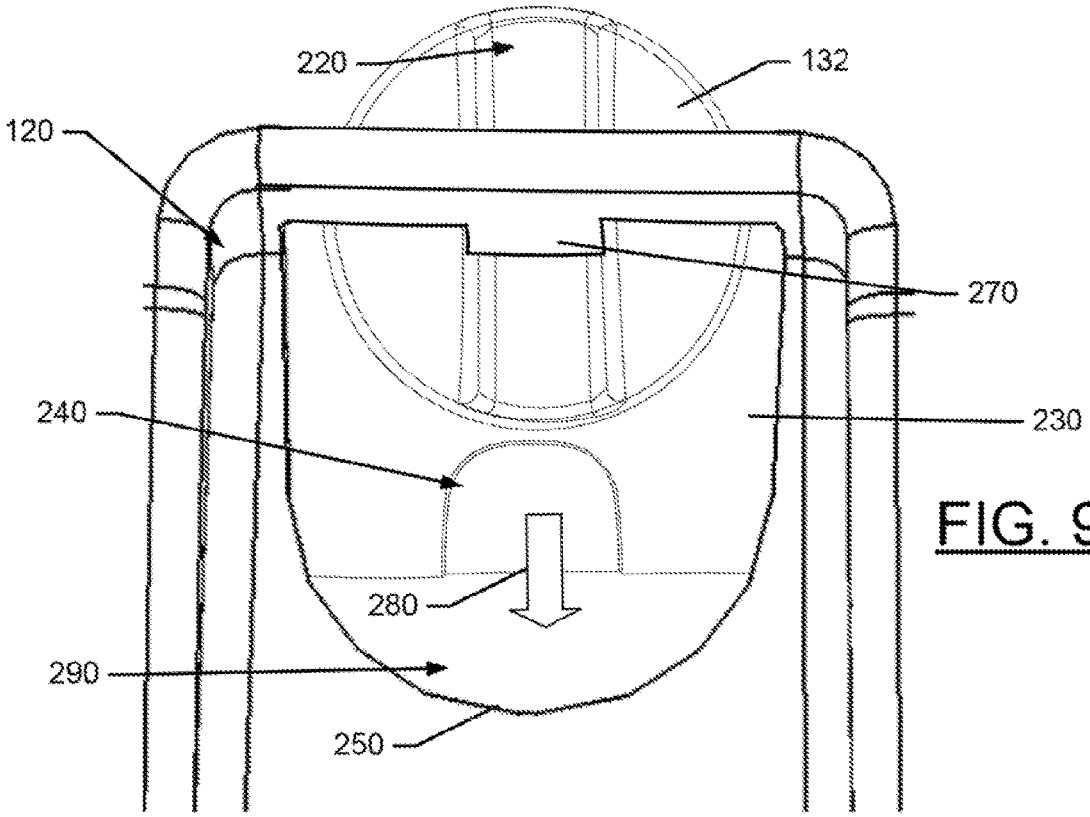
FIG. 9A is a side view of the boss being inserted into the rail holding slot according to an example embodiment.
Figure 9B:
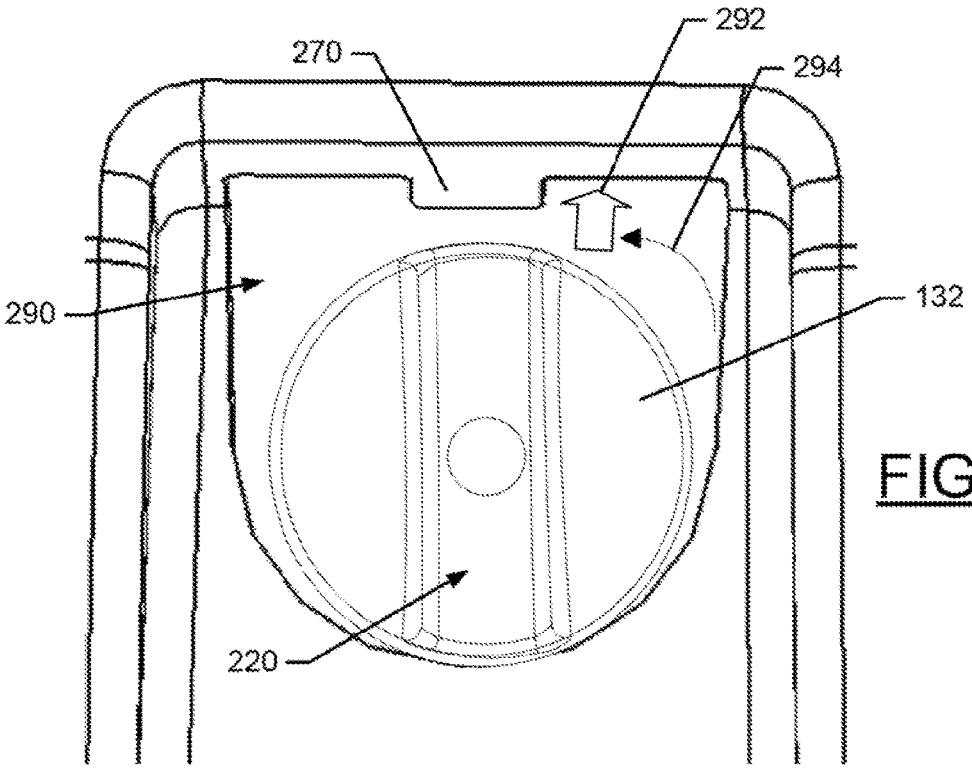
FIG. 9B is a side view of the boss within the rail holding slot in alignment for installation or removal according to an example embodiment.

FIG. 8 and FIG. 9, which is defined by FIGS. 9A, 9B, 9C and 9D, show side views of the rail 130 and the retention boss 132 of one side of the rail 130 in each of the three lockable positions. In this regard, FIG. 9A shows the retention boss 132 being inserted into the rail holding slot 120 (i.e., moved downward in the direction of arrow 280) until the rail 130 is locked in place via engagement of the first locking slot 240 and the locking protrusion 260 as shown in FIG. 9B. The position shown in FIG. 9B correlates to the install/remove position 300 shown in FIG. 8. In the install/remove position 300, the driven component 140 extends substantially at a 45 degree angle relative to the base portion of the case 100. The rail 130 can then be removed as shown by arrow 302 to the removed position 305 shown in FIG. 8.

From the position shown in FIG. 9B, the retention boss 132 may be withdrawn in the direction of arrow 292 far enough to withdraw the locking protrusion 260 from the first locking slot 240. Then the retention boss 132 may be rotated in the direction of arrow 294 to achieve alignment between the locking protrusion 260 and the second locking slot 242. However, in some cases, the frame member 110 may be sized such that the retention boss 132 consumes all of the space between the collar portion 250 and the locking protrusion 270. In such examples, the frame member 110 may be resilient enough to flex to allow the locking protrusion 260 to flex outwardly and permit the locking protrusion 260 to exit the first locking slot 270 and slide over the base portion 230 rotating in the direction of arrow 294 to the second locking slot 242. The locking protrusion 260 may be seated within the second locking slot 242 and the position shown in FIG. 9C may be achieved. The position shown in FIG. 9C correlates to the use position 310 shown in FIG. 8. In the use position 310 of FIG. 8, the driven component 140 extends substantially perpendicularly away from the base portion of the case 100.

As shown in FIG. 9C, the retention boss 132 may be withdrawn in the direction of arrow 292 far enough to withdraw the locking protrusion 260 from the second locking slot 242 (or slid out of the second locking slot 242 due to flexing of the frame member 110 as described above). Then the retention boss 132 may be rotated in the direction of arrow 294 to achieve alignment between the locking protrusion 260 and the third locking slot 244. The locking protrusion 260 may be seated within the third locking slot 244 and the position shown in FIG. 9D may be achieved. The position shown in FIG. 9D correlates to the storage position 320 shown in FIG. 8. In the storage position 320 of FIG. 8, the driven component 140 extends substantially parallel to the base portion of the case 100.

When the retention boss 132 is in the positions shown in FIGS. 9B, 9C and 9D, the retention boss 132 may be considered to be in a locked (or fixed) state. In this regard, rotation of the retention boss 132 within the receiving orifice 290 may not be possible (or at least be inhibited until enough force is exerted to cause the frame member 110 to flex to release the locking protrusion 260 from one of the locking slots) in the locked state. However, when the retention boss 132 is not locked relative to the collar portion 250, but still located in the receiving orifice 290, the retention boss 132 may be considered to be in a rotatable state. In this regard, the retention boss 132 (and therefore the rail 130) may be rotated relative to the frame member 110 and the rail holding slots 132. In some cases, the rotation may enable the retention boss 132 to be rotated to a different one of the potential fixed positions in which the retention boss 132 can be locked or otherwise retained (e.g., associated with the first, second and third locking slots 240, 242 and 244). Moreover, at any time during which the alignment slot 220 and the alignment protrusion 270 are not in alignment, the alignment protrusion 270 may prevent withdrawal of the retention boss 132 from the rail holding slots 120.

Accordingly, some example embodiments may provide a case for storing drivable components. The case may include a first half shell and a second half shell operably coupled to each other via a hinge, a frame member included in at least one of the first half shell or the second half shell, and a rail including a plurality of receptacles configured to receive respective ones of the drivable components. The frame member may include rail holding slots disposed in lateral sides of the frame member. The rail may be configured to be removable from the rail holding slots and rotatable in the rail holding slots between selected ones of a plurality of predetermined rail positions.

The case and/or the rail described above may be augmented or modified by altering individual features mentioned above or adding optional features. The augmentations or modifications may be performed in any combination and in any order. For example, in some cases, the rail may include a body in which each of the receptacles is formed, and a retention boss at each opposing end of the body. The retention boss may be configured to be received in the rail holding slots in a selected one of locked state or a rotatable state. The locked state (or retained state) may fix the rail relative to the frame member in a selected one of the predetermined rail positions. The rotatable state enables the rail to rotate about an axis of the rail between each of the predetermined rail positions. The body may have a length less than a distance between a pair of the rail holding slots positioned opposite each other in the lateral sides of the frame member. In an example embodiment, the drivable components may each include a quarter-inch hex shaft. In some cases, one of the predetermined rail positions may include a use position in which the rail is fixed in an orientation in which the drivable components extend substantially perpendicularly away from a base portion forming an outer wall of the case. In an example embodiment, one of the predetermined rail positions may include a storage position in which the rail is fixed in an orientation in which the drivable components extend substantially parallel to a base portion forming an outer wall of the case. In some cases, one of the predetermined rail positions may include an install/remove position in which the rail is fixed in an orientation in which the drivable components extend about 45 degrees away from a base portion forming an outer wall of the case. In an example embodiment, the rail may be configured to be removable from the rail holding slots from one of the predetermined rail positions, and may also be insertable into the rail holding slots in the same one of the predetermined rail positions. In an example embodiment, the end face may include a plurality of locking slots extending radially outwardly from the retention boss. In some cases, the frame member may further include a locking protrusion. The locking protrusion may be alignable with a selected one of the locking slots to insert the locking protrusion into the selected one of the locking slots to fix the rail relative to the frame member. In an example embodiment, the rail holding slots may each further include a collar portion disposed proximate to a locking protrusion and defining a receiving orifice, where the locking protrusion and alignment protrusion are disposed on opposite sides of the receiving orifice. The retention boss may be rotatable within the receiving orifice when neither the alignment slot nor any one of the locking slots engages a respective one of the alignment protrusion and the locking protrusion. In some cases, a first locking slot may be substantially aligned with the alignment slot, and the locking protrusion may be aligned with the alignment protrusion such that the rail is positionable to align both the first locking slot with the locking protrusion and the alignment slot with the alignment protrusion to enable installation and fixing of the rail relative to the frame member. In an example embodiment, a second locking slot may be disposed about 45 degrees away from the first locking slot in the end face, and the second locking slot may be engageable with the locking protrusion to define a use position in which the rail is fixed in an orientation in which the drivable components extend substantially perpendicularly away from a base portion forming an outer wall of the case. In some cases, a third locking slot may be disposed about 135 degrees away from the first locking slot in the end face, and the third locking slot may be engageable with the locking protrusion to define a storage position in which the rail is fixed in an orientation in which the drivable components extend substantially parallel to a base portion forming an outer wall of the case.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A case for storing drivable components, the case comprising:

a first half shell and a second half shell operably coupled to each other via a hinge;

a frame member included in at least one of the first half shell or the second half shell; and a rail comprising a plurality of receptacles configured to receive respective ones of the drivable components and a retention boss, wherein the frame member comprises rail holding slots disposed in lateral sides of the frame member, each rail holding slot comprising an alignment protrusion, wherein the rail is configured to be removable from the rail holding slots and rotatable in the rail holding slots between selected ones of a plurality of predetermined rail positions, wherein the retention boss comprises an alignment slot formed therein and wherein the rail is removable from or insertable into the rail holding slots based on alignment of the alignment slot and the alignment protrusion, and wherein an end face of the rail comprises a plurality of locking slots extending radially outwardly from the retention boss, each locking slot being associated with one of the selected ones of the plurality of predetermined rail positions.

2. The case of claim 1, wherein the rail comprises a body in which each of the receptacles is formed;

wherein the retention boss is configured to be received in one of the rail holding slots in a selected one of a retained state or a rotatable state, wherein the retained state fixes the rail relative to the frame member in a selected one of the predetermined rail positions, and wherein the rotatable state enables the rail to rotate about an axis of the rail between each of the predetermined rail positions.

3. The case of claim 2, wherein the body has a length less than a distance between a pair of the rail holding slots positioned opposite each other in the lateral sides of the frame member.

4. The case of claim 1, wherein the drivable components each include a quarter-inch hex shaft.

5. The case of claim 1, wherein one of the predetermined rail positions comprises a use position in which the rail is fixed in an orientation in which the drivable components extend substantially perpendicularly away from a base portion forming an outer wall of the case.

6. The case of claim 1, wherein one of the predetermined rail positions comprises a storage position in which the rail is fixed in an orientation in which the drivable components extend substantially parallel to a base portion forming an outer wall of the case.

7. The case of claim 1, wherein one of the predetermined rail positions comprises an install/remove position in which the rail is fixed in an orientation in which the drivable components extend about 45 degrees away from a base portion forming an outer wall of the case.

8. The case of claim 1, wherein the rail is configured to be removable from the rail holding slots and one of the predetermined rail positions, and is also insertable into the rail holding slots in the same one of the predetermined rail positions.

9. A case for storing drivable components, the case comprising:

a first half shell and a second half shell operably coupled to each other via a hinge;

a frame member included in at least one of the first half shell or the second half shell; and a rail comprising a plurality of receptacles configured to receive respective ones of the drivable components, wherein the frame member comprises rail holding slots disposed in lateral sides of the frame member, each rail holding slot comprising an alignment protrusion, wherein the rail comprises a body at which each of the receptacles is formed, and a retention boss at each opposing end of the body, wherein the retention boss extends away from an end face of the body, the retention boss further including an alignment slot formed therein, wherein the rail is removable from or insertable into the rail holding slots based on alignment of the alignment slot and the alignment protrusion, wherein the rail is rotatable when retained in the rail holding slots, and wherein the end face comprises a plurality of locking slots extending radially outwardly from the retention boss.

10. The case of claim 9, wherein the frame member further comprises a locking protrusion, wherein the locking protrusion is alignable with a selected one of the locking slots to insert the locking protrusion into the selected one of the locking slots to fix the rail relative to the frame member.

11. The case of claim 10, wherein the rail holding slots each further comprise a collar portion disposed proximate to a locking protrusion and defining a receiving orifice, the locking protrusion and alignment protrusion being disposed on opposite sides of the receiving orifice, and wherein the retention boss is rotatable within the receiving orifice when neither the alignment slot nor any one of the locking slots engages a respective one of the alignment protrusion and the locking protrusion.

12. The case of claim 11, wherein a first locking slot is substantially aligned with the alignment slot, and the locking protrusion is aligned with the alignment protrusion such that the rail is positionable to align both the first locking slot with the locking protrusion and the alignment slot with the alignment protrusion to enable installation and fixing of the rail relative to the frame member.

13. The case of claim 12, wherein a second locking slot is disposed about 45 degrees away from the first locking slot in the end face, the second locking slot being engageable with the locking protrusion to define a use position in which the rail is fixed in an orientation in which the drivable components extend substantially perpendicularly away from a base portion forming an outer wall of the case.

14. The case of claim 12, wherein a third locking slot is disposed about 135 degrees away from the first locking slot in the end face, the third locking slot being engageable with the locking protrusion to define a storage position in which the rail is fixed in an orientation in which the drivable components extend substantially parallel to a base portion forming an outer wall of the case.

15. A rail for holding drivable components within a case, the rail comprising:

a body in which a plurality of receptacles configured to receive respective ones of the drivable components are formed; and a retention boss at each opposing end of the body, wherein the retention boss extends away from an end face of the body, the retention boss further including an alignment slot formed therein, wherein the rail is removable from or insertable into the case, and is rotatable relative to the case, based on alignment of the alignment slot with retention features formed in the case, and wherein the end face comprises a plurality of locking slots extending radially outwardly from the retention boss.

16. The rail of claim 15, wherein the retention features of the case include a locking protrusion that is alignable with a selected one of the locking slots to insert the locking protrusion into the selected one of the locking slots to fix the rail relative to the frame member, and wherein a first locking slot is substantially aligned with the alignment slot, and the locking protrusion is aligned with and inserted into the first locking slot to enable installation and fixing of the rail relative to the case.

17. The rail of claim 16, wherein a second locking slot is disposed about 45 degrees away from the first locking slot in the end face, the second locking slot being engageable with the locking protrusion to define a use position in which the rail is fixed in an orientation in which the drivable components extend substantially perpendicularly away from a base portion forming an outer wall of the case.

18. The rail of claim 16, wherein a third locking slot is disposed about 135 degrees away from the first locking slot in the end face, the third locking slot being engageable with the locking protrusion to define a storage position in which the rail is fixed in an orientation in which the drivable components extend substantially parallel to a base portion forming an outer wall of the case.

* * * * *